United States Patent [19]

Martin et al.

[11] 3,978,315

[45] Aug. 31, 1976

[54] ELECTRICAL HEATING UNITS

[75] Inventors: Francis W. Martin, Painted Post; Paul L. Rose, Corning, both of N.Y.

[73] Assignee: Corning Glass Works, Corning, N.Y.

[22] Filed: Sept. 19, 1975

[21] Appl. No.: 614,798

[52] U.S. Cl. ..... 219/543; 338/308; 427/125

[51] Int. Cl.[2] ..... H05B 3/16

[58] Field of Search ..... 219/438, 464, 543; 252/514; 338/308, 309; 427/97, 123, 124, 125

[56] References Cited

UNITED STATES PATENTS

| | | | |
|---|---|---|---|
| 3,067,315 | 12/1962 | Hurko | 219/543 |
| 3,496,336 | 2/1970 | Hignorany et al. | 219/464 |
| 3,679,473 | 7/1972 | Blatchford et al. | 427/96 |
| 3,694,627 | 9/1972 | Blatchford et al. | 219/543 |
| 3,805,023 | 4/1974 | Wainer et al. | 219/543 |
| 3,869,596 | 3/1975 | Howie | 219/438 |

*Primary Examiner*—Volodymyr Y. Mayewsky
*Attorney, Agent, or Firm*—Kees van der Steere; Clinton S. Janes, Jr.; Clarence R. Patty, Jr.

[57] ABSTRACT

An electrical heating unit of the integral element type, comprising an electrical heating element indirectly bonded to a supporting lithium aluminosilicate glass-ceramic plate, is described. The glass-ceramic plate is provided with a semicrystalline zinc aluminosilicate coating which protects it from the harmful effects of interaction with subsequently applied ceramic and metallic compositions making up the heating element and associated components.

4 Claims, 1 Drawing Figure

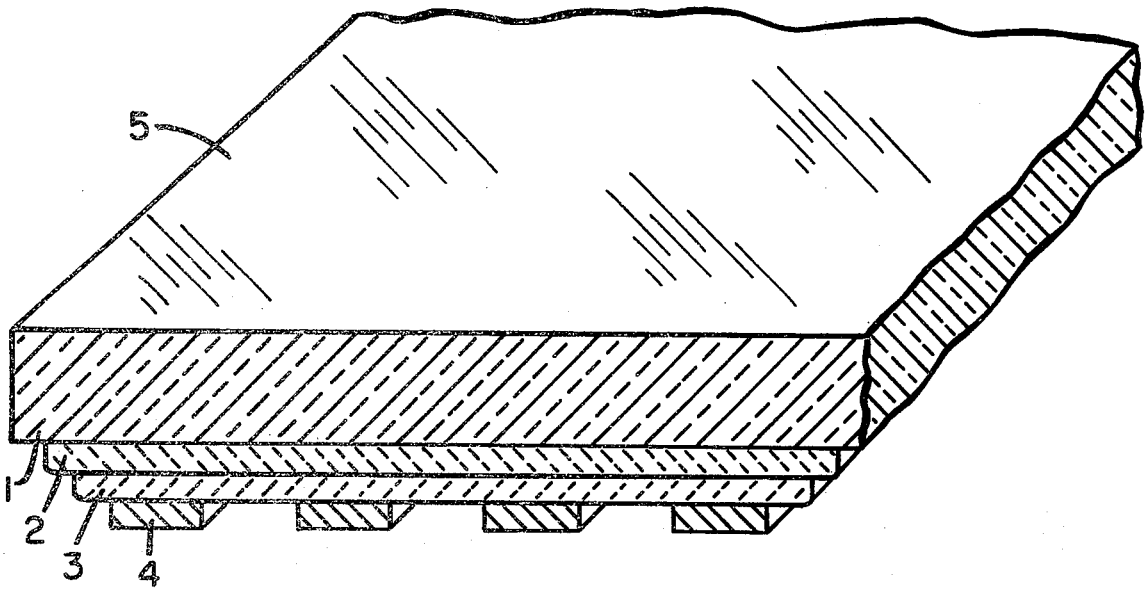
5
1
2
3
4

ELECTRICAL HEATING UNITS

BACKGROUND OF THE INVENTION

The present invention is in the field of electrical heating and particularly relates to electrical heating units of the so-called integral element type, comprising a glass or other ceramic heating plate or block, which plate or block is heated by an electrical heating element indirectly bonded thereto. Such heating units are particularly useful for electrical cooking ranges, hot plates, and other electrical heating appliances.

U.S. Pat. No. 3,086,101 discloses an electrical heating unit comprising a glass plate having an electrical heating element in physical contact with the lower surface thereof. This unit may optionally include an alumina coating between the element and the plate to prevent chemical interaction therebetween at elevated temperatures.

U.S. Pat. No. 3,067,315 discloses an electrical heating unit of improved heating characteristics comprising a high silica glass plate having directly bonded to the lower surface thereof a thin noble metal film which acts as the electrical heating element of the unit. However, supporting plates having decreased optical transparency and higher strength, particularly higher impact strength, are desired.

Since the discovery of the so-called glass-ceramic family of ceramic materials, such as described in U.S. Pat. No. 2,920,971, electrical heating units comprising glass-ceramic plates heated by electrical heating elements have been introduced into commerce. The strength, low porosity and excellent thermal properties of certain of these glass-ceramic materials have provided electric ranges and other electrical heating units of excellent appearance and cleanability. Up to the present time, however, electrical heating units comprising glass-ceramics have generally been of the discrete element type, such as described in U.S. Pat. No. 3,889,021 and British Pat. No. 1,391,076, wherein the electrical heating element is not directly bonded to but is simply in close physical contact with or proximity to the glass-ceramic plate to be heated. Integral element heating units offer substantial advantages in heating efficiency, but numerous problems are associated with the development of such units.

One of the most important requirements of a glass-ceramic material to be utilized as a burner plate for an electrical heating unit is high strength. Such plates may be subjected to heavy impacts in use and the cost of replacement of the entire plate upon breakage is prohibitive. Glass-ceramic materials normally exhibit higher modulus of rupture strengths than glasses; hence glass-ceramic electrical heating units of the discrete electrical element type typically exhibit adequate resistance to breakage on impact.

Among the glass-ceramic materials presently employed in the fabrication of electrical heating units such as electric ranges are lithium aluminosilicate glass-ceramics of the beta spodumene type or the beta spodumene-beta eucryptite type. Such glass-ceramics exhibit high strength, low thermal expansion, excellent thermal stability and good appearance and cleanability.

However, the use of lithium aluminosilicate glass-ceramics of these types in high temperature electrical applications where voltages are to be directly applied to elements in contact with the glass-ceramic plate requires that a high resistivity electrical barrier be interposed between the plate and the electrical elements, since the high temperature electrical resistivity of lithium aluminosilicates is rather low. Accordingly, a high-resistivity ceramic coating such as, for example, a cordierite coating, is applied to the lithium aluminosilicate glass-ceramic prior to the attachment of electrical heating elements thereto.

We have discovered that serious strength deterioration is encountered in presently available lithium aluminosilicate glass-ceramic burner plate materials upon the application of ceramic electrical barrier layers thereto for the purpose of providing a base for an integral electrical heating element. This problem is apparently related to physical and/or chemical interactions occuring between glass-ceramic substrates and the coating materials applied thereto. These interactions may occur when the base plate and layer are heated, either during the application of the coating material or during the operation of the unit. Thus glass-ceramic burner plate material exhibiting sufficient modulus of rupture strength for use in conventional thicknesses for discrete element electrical heating units may exhibit insufficient strengths following the application of insulating ceramic coating constituents thereto.

This problem is apparently not limited to units comprising electrically-insulating ceramic coatings, but may also occur when other ceramic, metallic, or cermet compositions are directly bonded to the glass-ceramic surface. On the other hand, strength deterioration is normally not observed when superficially adhering coatings are applied. It therefore appears that the difficulties of directly bonding coating compositions to lithium aluminosilicate glass-ceramic plates stem from physical and/or chemical incompatibilities between the plate materials and the ceramics, metals or cermets to be bonded thereto.

SUMMARY OF THE INVENTION

We have now discovered ceramic compositions which may be bonded to lithium aluminosilicate glass-ceramic burner plate materials without substantially degrading the strength of the plate. These compositions are provided from sinterable, thermally-crystallizable zinc aluminosilicate glasses which are powdered and applied to the glass-ceramic plate to provide a coating. The plate and coating are then fired at an elevated temperature to sinter the glass, bond the glass to the plate, and crystallize the glass. The resulting bonded coating, which may be characterized as a semicrystalline coating, normally exhibits excellent adherence to the glass-ceramic base plate, yet appears to be fully compatible therewith. Neither substantial initial strength deterioration upon application nor other short or long term interactions with the base plate are observed. Moreover, the coating is effective to substantially insulate the glass-ceramic plate from strength loss or other damage when metallic, ceramic or cermet compositions, such as insulating ceramic coatings or electrically conductive compositions for heating elements, are subsequently bonded to the coating.

The semicrystalline coating consists of a major crystal phase containing crystals of zinc beta quartz dispersed in a residual glassy matrix. Minor amounts of magnesium or cobalt may be found in solid solution with the quartz phase in crystallized glasses containing these elements. These crystals form in the zinc aluminosilicate glass as the glass and plate are heated, during or subsequent to the process of sintering and bonding the glass to the plate at temperatures near the softening point of the glass. The semicrystalline coating is largely crystalline (at least about 50% by volume), and exhibits excellent thermal stability and low thermal expansion.

Following the application of this zinc aluminosilicate semicrystalline coating to the lithium aluminosilicate glass-ceramic plate, an insulating barrier such as a cordierite coating and/or an electrically conductive film such as a noble metal-containing film may be sequentially applied to coated regions of the plate in accordance with any suitable method. Thus a strong, efficient electrical heating unit comprising a lithium aluminosilicate glass-ceramic plate, a protective semicrystalline zinc aluminosilicate coating bonded to at least a portion of the surface of the plate, an electrically-insulating barrier layer bonded to the semicrystalline coating, and an electrical heating element consisting of a conductive film bonded to the barrier layer, may be provided.

DESCRIPTION OF THE DRAWING

The DRAWING consists of an oblique partial schematic view in cross-section of a heating unit provided in accordance with the present invention, showing a lithium aluminosilicate glass-ceramic burner plate 1 to the lower surface of which is bonded a protective semicrystalline zinc aluminosilicate coating 2. An electrically-insulating barrier layer 3 composed of cordierite is bonded to semicrystalline zinc aluminosilicate coating 2. Bonded to layer 3 is an electrically-conductive film 4 which is heatable by the passage of an electrical current therethrough, said film comprising the heating element of the unit. Upon passing an electrical current through film 4, the unit including upper heating surface 5 is heated to provide a heat source for heating thermal loads in contact with or proximity to surface 5.

DETAILED DESCRIPTION

Glass-ceramic materials useful for the fabrication of burner or base plates in electrical heating units provided in accordance with the invention include any of the known, low thermal expansion, high strength, thermally stable lithium aluminosilicate glass-ceramic compositions. Desirably, glass-ceramic materials for this application have high modulus of rupture strengths (on the order of at least about 15,000 psi.), and low average linear coefficients of thermal expansion (typically not exceeding about $20 \times 10^{-7}$°C. over the range from 0°–800°C.). The selected material should also exhibit good physical and dimensional stability on repeated thermal cycling to 800°C. High chemical durability is of course a further implicit requirement of burner plate materials.

Preferred glass-ceramic compositions for the manufacture of base plates include beta spodumene glass-ceramics, beta eucryptite glass-ceramics, and beta eucryptite-beta spodumene glass ceramics.

Beta spodumene glass-ceramics are of lithium aluminosilicate composition and comprise a principal crystal phase consisting of crystals selected from the group consisting of beta spodumene ($Li_2O.Al_2O_3.4SiO_2$) and beta spodumene solid solutions. Glass-ceramic materials of this type are known which have excellent high temperature stability, modulus of rupture strengths of at least about 12,000 psi., and average linear coefficients of thermal expansion in the range of about 8–20 × $10^{-7}$/°C.

Beta eucryptite and beta eucryptite-beta spodumene glass-ceramics are of lithium aluminosilicate composition and comprise a principal crystal phase consisting of crystals selected from the group consisting of beta eucryptite ($Li_2O.Al_2O_3.2SiO_2$), beta eucryptite solid solutions, beta spodumene and beta spodumene solid solutions. Glass-ceramics of this type are known which have good high temperature stability, modulus of rupture strengths of at least about 15,000 psi., and average linear coefficients of thermal expansion in the range of about −10 to 20 × $10^{-7}$/°C.

Of course other lithium aluminosilicate glass-ceramic materials having the required strength, low expansion, thermal stability and chemical durability could also be employed to fabricate a glass-ceramic base plate.

The unabraded modulus of rupture strengths of lithium aluminosilicate glass-ceramics are normally quite high. Table I below sets forth the results of a series of modulus of rupture tests wherein five groups of eight bars each were tested. The dimensions of all bars were 2.75 × 0.5 × 0.150 inches. The bars were composed of a beta spodumene type glass-ceramic material having an approximate composition in weight percent on the oxide basis, of about 3.5% $Li_2O$, 20.5% $Al_2O_3$, 67.8% $SiO_2$, 4.8% $TiO_2$, 1.6% MgO, 1.2% ZnO, and 0.2% F.

Table I reports mean modulus of rupture values for each group, in pounds per square inch of cross-sectional surface area, the standard deviation in each group in psi., and the standard deviation as a percent of the mean. All testing was carried out utilizing a double-knife-edge testing apparatus in accordance with conventional strength testing procedures.

TABLE I

Uncoated $Li_2O.Al_2O_3.SiO_2$ Glass-Ceramics
Modulus of Rupture Strengths

| Group No. | Modulus of Rupture (psi) | Standard Deviation (psi) | Standard Deviation (%) |
|---|---|---|---|
| 1 | 27,400 | 4638 | 16.9 |
| 2 | 24,700 | 3234 | 13.1 |
| 3 | 32,500 | 2513 | 7.7 |
| 4 | 37,000 | 1585 | 4.3 |
| 5 | 27,400 | 3476 | 12.7 |

Unfortunately, the substantial strengths of lithium aluminosilicate glass-ceramics can be considerably reduced by the application of electrical barrier layer materials to the glass-ceramic surface, if these electrical barrier layers are required to be strongly bonded to the plate surface and are thus applied by high-temperature sintering. Typical strength losses may be illustrated by a similar series of modulus of rupture tests performed on bars having a portion of a surface thereof coated with an electrical barrier layer material. Table II sets forth strength data illustrating the decreased strengths observed when groups of bars such as reported in Table I are provided with a 8–16 mils thick cordierite barrier coating formed by firing on and crystallizing a sinterable cordierite glass at temperatures in the 950°–1000°C. range. The bars are otherwise of the same configuration and composition as those described in Table I.

TABLE II

Cordierite-Coated $Li_2O$-$Al_2O_3$-$SiO_2$ Glass Ceramics
Modulus of Rupture Strengths

| Group No. | Coating Thickness | Modulus of Rupture (psi) | Standard Deviation (psi) | Standard Deviation (psi) |
|---|---|---|---|---|
| 6 | 16 mils | 13,400 | 426 | 3.2 |
| 7 | 8 mils | 7,860 | 781 | 10.0 |
| 8 | 14 mils | 7,100 | 471 | 6.6 |
| 9 | 16 mils | 5,200 | 616 | 11.9 |
| 10 | 16 mils | 6,760 | 846 | 12.5 |
| 11 | 8 mils | 6,555 | 583 | 8.9 |

These data show substantial strength reductions from the strengths of the uncoated glass-ceramic material, and are consistent with our observation that unacceptable strength losses normally occur when cordierite electrical barrier layer materials are directly bonded by sintering to lithium aluminosilicate glass ceramics.

Protective semicrystalline coatings utilized in accordance with the invention to minimize loss of strength caused by the application of subsequent coatings are provided from sinterable thermally-crystallizable zinc aluminosilicate glasses having compositions consisting essentially, in weight percent on the oxide basis, of about 12–25% ZnO, 0–3% MgO, 0–3% CoO, 15–25% total of ZnO + MgO + CoO, 15–28% $Al_2O_3$, 50–65% $SiO_2$, and at least about 0.5% total of oxides selected in amounts not exceeding the indicated proportions from the group consisting of up to 5% $Cs_2O$, up to 1% $K_2O$, and up to 4% BaO. These glasses exhibit good sintering characteristics and are capable of forming an excellent bond with lithium aluminosilicate glass-ceramic substrates without deleteriously affecting the strength thereof. They also crystallize fairly rapidly from the powdered state to provide a low-expansion semicrystalline coating.

The recited glass compositions may of course contain minor amounts of other oxides which do not harmfully affect the sintering, bonding and crystallization characteristics thereof. However, the glasses should be kept essentially free of constituents such as $ZrO_2$ and certain noble metals which are known nucleating agents for beta quartz crystals. These agents can lead to excessively rapid crystallization, and thus poor sintering and bonding, in the coating.

Table III below sets forth examples of zinc aluminosilicate glasses within the above-described composition range which may be employed in the application of semicrystalline coatings to lithium aluminosilicate glass-ceramics. Compositions are set forth in parts by weight on the oxide basis.

TABLE III

Zinc Aluminosilicate Coating Compositions

| | A | B | C | D | E | F | G | H | I |
|---|---|---|---|---|---|---|---|---|---|
| ZnO | 20.0 | 20.0 | 20.0 | 17.8 | 20.0 | 15.5 | 20.0 | 16.4 | 20.0 |
| $Al_2O_3$ | 25.0 | 25.0 | 25.0 | 22.3 | 25.0 | 23.4 | 25.0 | 26.3 | 25.0 |
| $SiO_2$ | 55.0 | 55.0 | 55.0 | 60.0 | 55.0 | 60.0 | 55.0 | 55.0 | 55.0 |
| $Cs_2O$ | 3.0 | 2.0 | — | 3.0 | — | 2.5 | 4.0 | 2.5 | 4.5 |
| $K_2O$ | — | — | 0.5 | — | — | — | — | — | — |
| BaO | — | — | — | — | 3.8 | — | — | — | — |
| MgO | — | — | — | — | — | 2.0 | — | 2.3 | — |

Glasses such as above described may be melted in accordance with conventional practice in pots, crucibles or the like at temperatures in the 1500°–1600°C. range, utilizing conventional glass batch constituents in proportions suitable for providing the specified compositions at the temperatures utilized for melting the batch.

The molten glass may be treated to provide glass powders of the selected composition utilizing any conventional technique, including fritting by pouring the melt as a thin stream into a quenching medium such as water, or by crushing and grinding glass shapes which are formed from the melt by casting, rolling or other convenient forming techniques.

Glass powders having a wide range of particle sizes may readily be provided utilizing known methods, and such powders may be used to provide coatings in accordance with the invention. However, coating uniformity and continuity are best if powders having average particle sizes in the range of about 4–12 microns are employed, and these powders are preferred.

The most convenient method of providing a coating of the glass on a glass-ceramic plate is to provide a paste or slurry of powdered glass in a suitable oil vehicle, and then to apply the glass-containing paste or slurry to the plate by brushing, spraying, silk-screening, doctor blading or other conventional techniques. The resulting coating is then fired to remove the binder, sinter and bond the glass to the plate, and crystallize the glass to provide the desired semicrystalline layer.

Sintering of these glasses normally occurs rapidly at temperatures in the 950°C. range, whereas crystallization occurs at temperatures in the range of about 825°–950°C. Higher crystallization temperatures may be utilized but are of no particular advantage. Heat treatments comprising heating for 15–60 minutes at temperatures in the range of 925°–950°C., are quite suitable for obtaining complete sintering and crystallization of the coating in most instances.

The compatibility of zinc aluminosilicate protective coatings with lithium aluminosilicate glass-ceramics such as are utilized for heating unit burner plates may be illustrated by modulus of rupture testing similar to the testing reported in Tables I and II above. Glass-ceramic bars identical in composition and configuration to the bars strength-tested as reported in Tables I and II are provided with coatings containing a powdered zinc aluminosilicate glass. The powdered glasses selected for the coatings have an average particle size of about 8–10 microns, and are applied as pastes in an oil vehicle at thicknesses in the range of about 1–6 mils. The bars and glass-containing coatings are fired at 950°C. for times in the range of about ½–1 hours to sinter and crystallize the glass powders to integral, strongly adherent, semicrystalline coatings.

Table IV below sets forth the results of such testing for groups of glass-ceramic bars comprising semicrystalline zinc aluminosilicate coatings having compositions selected from Table III above. Each group tested comprises at least 6 bars. Table IV reports the composition of the zinc aluminosilicate coating for each group, designated as reported in Table III, the mean modulus of rupture strength of the bars in each group, and the standard deviation from the mean in each group, expressed as a percent of the mean.

TABLE IV

Zinc Aluminosilicate-Coated $Li_2O$-$Al_2O_3$-$SiO_2$ Glass Ceramics Modulus of Rupture Strengths

| Group No. | Coating Composition (Ref. Table III) | Coating Thickness | Modulus of Rupture (psi) | Standard Deviation % |
|---|---|---|---|---|
| 12 | B* | 6 mils | 22,662 | 7.5 |
| 13 | E | 6 mils | 23,847 | 9.4 |
| 14 | C | 1 mil | 29,361 | 14.5 |
| 15 | B** | 1 mil | 22,850 | 7.7 |
| 16 | D | 5 mils | 24,030 | 14.5 |
| 17 | C | 3 mils | 24,283 | 8.1 |
| 18 | F | 5 mils | 19,370 | 10.0 |
| 19 | A | 2 mils | 29,531 | 14.1 |

*Strength-tested at 700°C.
**Strength-tested after thermal aging at 1030°C. for 32 hours.

From the data set forth in Table IV above, the substantial compatibility of protective zinc aluminosilicate coatings with lithium aluminosilicate glass-ceramic plates is readily apparent.

The best combination of properties for providing protective zinc aluminosilicate coatings is exhibited by glasses consisting essentially, in weight percent on the oxide basis, of about 12–25% ZnO, 0–3% MgO, 15–25% total of ZnO + MgO, 20–28% $Al_2O_3$, 50–60% $SiO_2$, 0–1% $K_2O$, 0–5% $Cs_2O$, 0.5–5% total of $K_2O$ + $Cs_2O$, and 0–4% BaO.

As previously noted, in fabricating an integral element electrical heating unit comprising a lithium aluminosilicate burner plate, a bonded electrical barrier layer is normally provided between the conductive element and the plate in order to eliminate leakage current to the heating surface. This electrical barrier layer must be strongly bonded and non-porous in order to provide a suitable substrate for an integral heating element; thus loosely-adhering prior art coatings such as alumina are not suitable. The preferred electrical barrier layer material is sintered crystalline cordierite. Particularly useful cordierite materials are those such as described in the copending patent application of F. W. Martin, Ser. No. 554,655, filed Mar. 3, 1975, and commonly assigned herewith, and that application is expressly incorporated herein by reference for a complete description of these materials. The protective zinc aluminosilicate semicrystalline coating provided in accordance with the present invention comprises an excellent substrate for the direct bonding of these and other ceramic coatings to the glass-ceramic plate.

In contrast to the large strength losses occuring when cordierite layers are applied directly to lithium aluminosilicate glass-ceramic plates, as illustrated by the data set forth above in Tables I and II, excellent strength retention is observed when protective zinc aluminosilicate coatings are interposed between the plate and the cordierite layers. This strength retention is illustrated by the data set forth in Table V below, which reports modulus of rupture values for glass-ceramic bars of a composition and size identical to the bars tested in Tables I, II and IV, but having a protective semicrystalline zinc aluminosilicate coating bonded to a surface of each bar and a cordierite layer bonded to the zinc aluminosilicate coating.

The data in Table IV is reported for groups of bars, each group consisting of 6 or more samples, including the mean modulus of rupture strengths for each group, in pounds per square inch, and the standard deviations in each group as a percent of the mean. Also reported are the compositions of the protective zinc aluminosilicate coating for each group, as shown in Table III, as well as the thicknesses of the protective coatings and cordierite layers provided on the bar samples.

TABLE V

| Test No. | $ZnO$-$Al_2O_3$-$SiO_2$ Coating | Thickness | Cordierite Layer Thickness | Modulus of Rupture (psi) | Standard Deviation % |
|---|---|---|---|---|---|
| 20 | B, | 1 mil | 16 mils | 29,800 | 14.2 |
| 21 | D, | 1 mil | 8 mils | 23,190 | 8.4 |
| 22 | C, | 3 mils | 8 mils | 29,810[1] | 12.6 |
| 23 | D, | 3 mils | 10 mils | 16,220 | 8.7 |
| 24 | C, | 3 mils | 10 mils | 26,124[2] | 7.2 |
| 25 | C, | 5 mils | 10 mils | 22,812[3] | 7.6 |
| 26 | C, | 10 mils | 8 mils | 30,305[4] | 8.2 |

[1]Strength-tested after 500 hours at 700°C.
[2]Strength-tested at 500°C.
[3]Strength-tested at 600°C.
[4]Strength-tested after 1500 hours at 200°C.

These data illustrate the substantial effectiveness of zinc aluminosilicate coatings to protect lithium aluminosilicate glass-ceramic plates from strength degradation during the application of subsequent ceramic layers provided for purposes related to the fabrication of the completed heating unit. Coating thicknesses in the range of 1–10 mils are normally sufficient to protect the plate from interaction with most of the ceramic and/or metallic compositions which may subsequently be applied.

In a typical manufacturing process, following the application of an electrical barrier layer such as a cordierite layer, a suitable conductive film is bonded to the electrical barrier layer in a configuration useful for an integral electrical heating element. The conductive film may be a metallic film composed, for example, of noble metals such as platinum, gold, palladium, or mixtures thereof, or it may be a conductive cermet film composed of a mixture of a conductive metal and a ceramic binder. Preferably, the integral heating element consists of a thin noble metal film. Conventional methods for applying the element materials to ceramic surfaces are utilized to bond them to the barrier layer material.

An electrical heating unit produced in the described manner, comprising a lithium aluminosilicate glass-ceramic plate, a semicrystalline zinc aluminosilicate coating bonded to the plate, an electrically-insulating barrier layer bonded to the semicrystalline coating, and an electrical heating element bonded to the insulating layer, is a particularly suitable unit for use in accordance with the present invention.

The invention may be further understood by reference to the following detailed example describing the fabrication of an integral element heating unit in accordance therewith.

EXAMPLE

A glass-ceramic plate about 21⅝ inches in length, 12⅜ inches in width, and 0.170 inches in thickness is selected for preparation. The plate is composed of a lithium aluminosilicate glass-ceramic material comprising a beta spodumene solid solution as the principal crystal phase, and has an approximate oxide composition, in weight percent, of about 3.5% $Li_2O$, 20.5% $Al_2O_3$, 67.9% $SiO_2$, 4.8% $TiO_2$, 1.6% MgO, 1.2% ZnO, and 0.2% F.

The surface of the plate which is to be the lower surface in operation as a heating unit is cleaned thoroughly with a detergent and rinsed in distilled water.

A coating of a paste containing a powdered crystallizable zinc aluminosilicate glass is applied to the cleaned lower surface of the plate. The paste consists of about 3 parts of powdered glass and 1 part of a volatile oil by weight. The oil is Drakenfeld No. 324 medium, available from Drakenfeld Colors, Hercules Inc., Washington, Pennsylvania. The powdered glass consists of particles having an average size in the range of about 8–10 microns, the glass having a composition, in weight percent, of about 19.9% ZnO, 24.9% $Al_2O_3$, 54.7% $SiO_2$, and 0.5% $K_2O$. The paste is applied by doctor blade, covering most of the lower plate surface to a thickness of about 8 mils.

The paste coating is dried after application by heating to 180°C. for 30 minutes to remove the volatile vehicle. Finally, the dried coating is fired to sinter and crystallize the glass by heating to 950°C. for 30 minutes, and cooling to room temperature. The resulting semicrystalline coating has a thickness of about 5 mils, is tightly adherent, and comprises a major crystal phase of beta quartz in a minor residual glassy matrix.

Following the application of this protective coating, an electrical barrier layer consisting essentially of cordierite is applied to the protectively-coated portions of the bottom surface of the plate. A paste consisting of 3 parts by weight of a powdered glass crystallizable to cordierite and 1 part by weight of Drakenfeld 324 oil is applied to the protectively coated bottom surface by doctor blade to provide a paste coating about 28 mils in thickness. The powdered glass thermally crystallizable to cordierite consists of glass particles with an average size in the range of about 8–10 microns, having an oxide composition, in weight percent, of about12.5% MgO, 36.2% $Al_2O_3$, 42.5% $SiO_2$, and 8.8% PbO. This coating is air dried and then heated to 500°C. to remove the volatiles. The coating is then sintered and crystallized to a dense, nonporous insulating cordierite layer by firing at a temperature of about 950°C. for 2 hours and cooling to room temperature.

Following the application of the protective zinc aluminosilicate coating and insulating cordierite layer, an electrical heating element consisting of an electrically conductive noble metal film is bonded to the cordierite layer. An organometallic solution of gold and platinum, containing, in weight percent, about 0.4% gold, 7.3% platinum, and the remainder organic constituents including solvents and vehicles, is applied to the surface of the cordierite layer through a 196 mesh silk screen to provide a continuous sinusoidal heating element pattern. The coating thus provided is converted to a thin film and fired onto the substrate by heating the substrate and coating to 125°C. for 15 minutes to remove volatile organics, further heating at a rate of about 200°C. per hour to 700°C., and finally removing the plate and bonded film from the furnace. The resulting element consists of a continuous strip of a gold-platinum alloy film about 0.4 microns in thickness, having a configuration providing an electrical resistance between terminal points of about 24 ohms at an operating temperature of 450°C.

The application of an alternating electrical voltage to the terminal points of the element results in rapid and efficient heating of the element, and of the upper surface of the glass-ceramic plate which comprises the active heating surface of the unit.

We claim:

1. An electrical heating unit comprising:

a. a lithium aluminosilicate glass-ceramic plate;

b. a semicrystalline coating bonded to at least a portion of a surface layer of the glass-ceramic plate, said coating consisting of a crystallized zinc aluminosilicate glass comprising a principal crystal phase of zinc beta quartz;

c. an electrically-insulating barrier layer composed of cordierite bonded to at least a portion of the semicrystalline coating; and d. an electrical heating element consisting of an electrically conductive noble metal film bonded to the electrically-insulating barrier layer.

2. An electrical heating unit in accordance with claim 1 wherein the lithium aluminosilicate glass-ceramic plate is composed of a glass ceramic material containing a major crystal phase selected from the group consisting of beta spodumene, beta spodumene solid solutions, beta eucryptite, beta eucryptite solid solutions, and mixtures thereof.

3. An electrical heating unit in accordance with claim 2 wherein the semicrystalline coating consists of a crystallized zinc aluminosilicate glass having a composition, in weight percent on the oxide basis, of about 12–25% ZnO, 0–3% MgO, 0–3% CoO, 15–25% total of ZnO + MgO + CoO, 15–28% $Al_2O_3$, 50–65% $SiO_2$, and at least about 0.5% total of oxides selected in amounts not exceeding the indicated proportions from the group consisting of up to 5% $Cs_2O$, up to 1% $K_2O$, and up to 4% BaO.

4. An electrical heating unit in accordance with claim 3 wherein the semicrystalline coating consists of a crystallized zinc aluminosilicate glass having a composition, in weight percent on the oxide basis, of about 12–25% ZnO, 0–3% MgO, 15–25% total of ZnO + MgO, 20–28% $Al_2O_3$, 50–60% $SiO_2$, 0–1% $K_2O$, 0–5% $Cs_2O$, 0.5–5% total of $K_2O + Cs_2O$, and 0–4% BaO.

* * * * *